US005657532A

United States Patent [19]

Alexander et al.

[11] Patent Number: 5,657,532

[45] Date of Patent: Aug. 19, 1997

[54] METHOD OF MAKING INSULATED ELECTRICAL HEATING ELEMENT USING LTCC TAPE

[75] Inventors: John H. Alexander; Simon P. Turvey, both of Goleta, Calif.

[73] Assignee: Ferro Corporation, Cleveland, Ohio

[21] Appl. No.: 587,312

[22] Filed: Jan. 16, 1996

[51] Int. Cl.[6] ..... H05B 3/00

[52] U.S. Cl. ..... 29/611; 219/457; 219/543; 264/605

[58] Field of Search ..... 29/611; 219/457, 219/464, 465, 543; 264/61

[56] References Cited

U.S. PATENT DOCUMENTS

| | | | |
|---|---|---|---|
| 4,450,346 | 5/1984 | Boaz | 219/522 |
| 4,645,552 | 2/1987 | Vitriol et al. | 156/89 |
| 4,697,165 | 9/1987 | Ishiguro et al. | 29/611 |
| 4,798,693 | 1/1989 | Mase et al. | 264/61 |
| 4,973,826 | 11/1990 | Baudry et al. | 219/464 |
| 5,252,809 | 10/1993 | Demin | 219/543 |
| 5,258,335 | 11/1993 | Muralidhar et al. | 501/20 |
| 5,502,293 | 3/1996 | Ohnishi et al. | 219/543 |
| 5,504,307 | 4/1996 | Hayashi et al. | 219/543 |
| 5,560,851 | 10/1996 | Thimm et al. | 219/543 |

*Primary Examiner*—P. W. Echols

*Attorney, Agent, or Firm*—Rankin, Hill, Lewis & Clark

[57] ABSTRACT

The present invention provides a method for making an insulated electrical heating element such as for domestic appliances to heat water, etc. wherein a resistive track is embedded in a dielectric ceramic insulating material. The method includes the steps of providing a rigid base plate; printing a resistive track on one surface of a segment of flexible tape comprising fusible ceramic particles in an organic binder; adhering the other surface of the tape segment to a surface of a base plate; and placing a second segment of flexible tape of the same type on the surface with the resistive track printed thereon. Then the resulting assembly is fired to fuse the ceramic particles of the tape segments and provide a ceramic layer on the base plate with an electrical resistive track insulated therewithin.

7 Claims, 1 Drawing Sheet

METHOD OF MAKING INSULATED ELECTRICAL HEATING ELEMENT USING LTCC TAPE

FIELD OF INVENTION

This invention relates to the manufacture of electrical heating devices for use in various domestic appliances such as coffee pots, tea kettles, etc. More particularly, the present invention relates to heating devices wherein an electrical resistive element is formed on an insulating ceramic material or composite substrate.

BACKGROUND

Various techniques are used to produce electrical heating elements for light household heating applications. In the past, such heating elements have included a resistive metal coil formed, for example, of metal rod. The coil is embedded in insulation which is in turned contained in a thermally conductive tubular metal sheath.

Other types of heating elements have consisted of wires embedded in a ceramic material. One more recent technique uses a porcelain enamel metal substrate with a thick film resistor material formed thereon.

These prior art techniques have been relatively burdensome and have required relatively expensive materials. The method of the present invention, however, is much less complex, uses less expensive materials and affords other features and advantages heretofore not obtainable.

SUMMARY OF THE INVENTION

The present invention provides an improved method for making an insulated electrical heating device wherein a thick film resistor track or pattern is printed on a flexible tape comprising fusible ceramic particles in an organic binder to provide the required electrical resistance. The electrical heating element is produced by the steps of:

1. providing a rigid base plate or substrate,
2. printing a resistive track or pattern on one surface of a first segment or piece of flexible tape comprising fusible ceramic particles in an organic binder,
3. adhering the other surface of the first tape segment to a surface of the base plate,
4. placing a second segment or piece of the flexible tape on the exposed surface of the first tape segment thereby overlying the printed resistive track, and
5. firing the resulting assembly to fuse the ceramic particles of the tape segments and to provide a monolithic structure having a ceramic layer bonded to the base plate with a resistive track insulated therewithin.

The composition of the ceramic particles and organic binder that form the flexible tape may include a variety of glass/ceramic dielectric materials. The product is usually the result of grinding the respective components to a fine powder and then mixing the respective powders with an organic binder to form a paste. The paste may then be applied or cast onto a flexible film backing or a substrate such as "MYLAR" to facilitate handling. The green or unfired tape may easily be removed from the MYLAR backing prior to fabrication. One preferred material for use as the flexible tape is conventionally available green low temperature cofired ceramic tape (LTCC tape).

The foregoing and other features of the invention are hereinafter more fully described and particularly pointed out in the claims, the following description setting forth in detail an illustrative embodiment of the invention, this being indicative, however, of but a few of the various ways in which the principles of the present invention may be employed.

DESCRIPTION OF THE PREFERRED EMBODIMENT

The invention will be described with reference to an insulated electrical heating element 10 that exemplifies the product that may be produced in accordance with the method of the invention. The article 10 may be utilized as a heat source, for example, in a small household appliance such as a coffee maker or tea pot.

Figure 1:
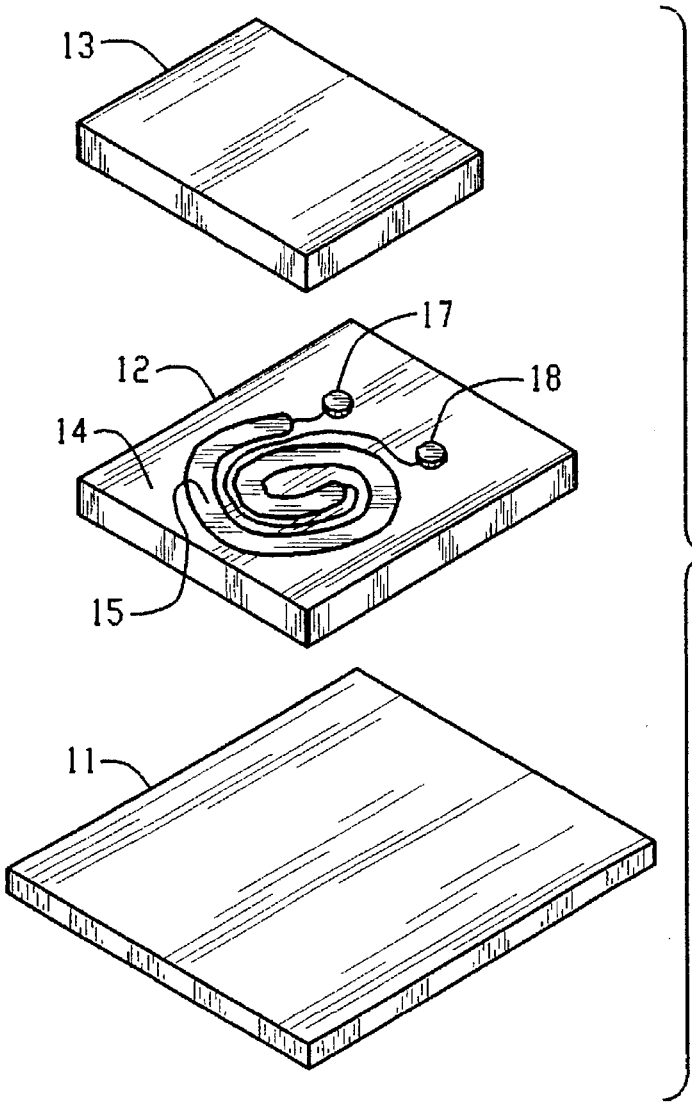
FIG. 1 is an exploded perspective view illustrating the construction of an insulated resistive heating element in accordance with the process of the invention.

The method of the invention may be best described with reference to FIG. 1. The components of the assembly include a rigid base plate 11 and two flat dielectric or insulating segments or sheets 12 and 13 initially formed of a "green" or unfired tape formed of ceramic particles and an organic binder.

The base plate 11 is formed of a rigid metal sheet. Preferably, base plate 11 comprises a steel such as stainless steel. Both ferritic and austenitic grades of stainless steel may be employed. The base plate 11 may be rectangular as illustrated in FIG. 1, however, it may be round or have a number of optional shapes. The tape segment 12 is generally rectangular and has dimensions somewhat less than the dimensions of the base plate 11. However, it will be appreciated that tape segment 12 may embody any desired shape. The tape segment 12 may have, for example, dimensions of 4½"×4 ½" in a typical application.

The upper surface 14 of the segment 12 has a resistive track or pattern 15 printed thereon in a generally spiral pattern. Of course, it will be appreciated that almost any desired pattern 15 may be formed. Terminals 17 and 18 are formed at the opposite ends of the track 15, the terminals being located adjacent one side edge as illustrated in FIG. 1. Any one of a variety of conventional electrical sources may be electrically connected to terminals 17 and 18. The flow of electrical current through resistive track 15 thereby generating heat.

Track 15 may be formed using various well-known or conventional printing techniques such as brushing and spraying; however, screen printing is generally preferred. Various thick film inks or pastes may be used to print the track 15. An example of one preferred thick film material is resistive thick film paste available from the Ferro Corporation of Cleveland, Ohio, under the trade designation 33-188. After printing, the segment 12 with the resistive track 15 formed thereon, is placed face-up on the rigid base plate 11. Then, another green tape segment 13 of generally rectangular form, but with one dimension somewhat less than the corresponding dimension of the tape segment 12, is applied over the face 14 of the segment 12. The tape segment 13 is so dimensioned and located that the terminals 17 and 18 are not covered but are in fact, left exposed for connection in an electrical circuit. Once again, it will be appreciated that as with segment 12, segment 13 may embody any desired shape.

A typical resistive heating track 15 may provide, for example, a resistance of 25 ohms. This would provide sufficient heating capacity for most light household appliance applications.

Figure 2:
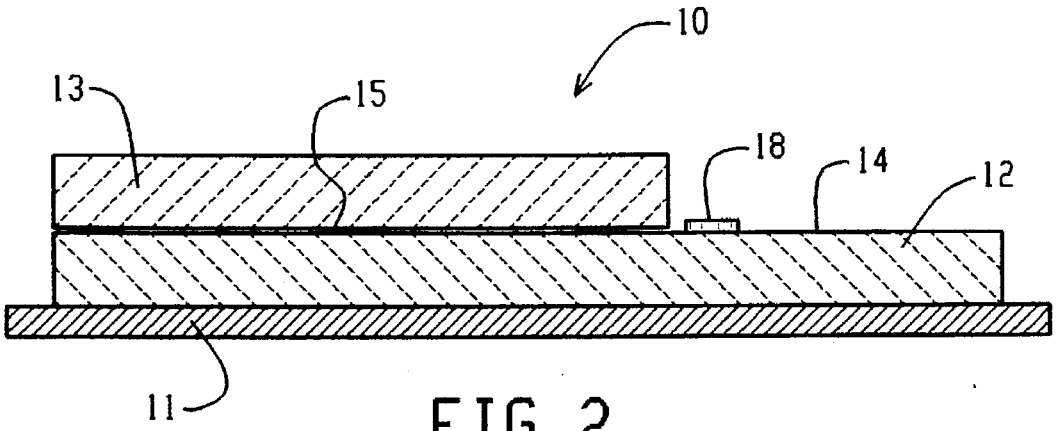
FIG. 2 is a sectional view of the heating element formed in accordance with the method of the invention.

Once the two tape segments 12 and 13 are aligned upon base plate 11, they are then laminated to the base plate 11. Lamination may be performed, for example, at a pressure of 3000 psi at 70° C. for about ten minutes. After lamination, the resulting raw laminate is fired or heated for about 45 minutes to a sintering temperature of from about 800° C. to about 950° C. to fuse the segments 12 and 13 to one another and to the base plate 11 (and to burn off the binder). The resulting heating element 10 is shown in section in FIG. 2.

The glasses and fillers that are used to make the flexible tape used to form segments 12 and 13 are preferably milled to about 1–10 microns average size. The binder may include a solvent, a surfactant and a plasticizer. Typical binders include acrylic components in poly-vinyl components. The plasticizer may include any of the phthalates. Additionally, viscosity modifiers, anti-skinning agents and the like can be used as is well-known in the art.

U.S. Pat. No. 5,258,335 to Muralidhar et al. discloses a method of producing a low temperature, co-fired, ceramic, dielectric green tape. That patent is incorporated herein by reference for its teachings of how to make a low temperature cofired ceramic (LTCC) dielectric green tape.

Various LTCC dielectric green tape products are commercially available. One example of a commercially available LTCC dielectric green tape product is a tape sold under the trade designation A-6 by the Ferro Corporation of Cleveland, Ohio. Another example of a commercially available LTCC dielectric green tape is a DuPont tape sold under the trade designation 851AT.

As to the particular composition of glasses, fillers and binders utilized to produce the sheets of green tape, many alternatives may be selected to satisfy different applications of the invention such as, for example, the firing time and temperature of the structure and the coefficient of expansion of the ceramic materials.

It will be understood that the method of the invention has been shown and described with respect to a specific embodiment thereof, and other variations and modifications of the specific method herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

We claim:

1. A process for fabricating an insulated electrical heating element comprising the steps of:

(a) providing a rigid base plate, (b) printing a resistive track on one surface of a first segment of flexible tape comprising fusible ceramic particles in an organic binder, (c) contacting the other surface of said first tape segment to a surface of said base plate, (d) placing a second segment of flexible tape comprising fusible ceramic particles in an organic binder on said one surface of said first tape segment so as to dispose said resistive track between said first and said second layer of flexible tape, (e) firing the resulting assembly to fuse said ceramic particles of said tape segments and provide a ceramic layer bonded on said base plate with an electrical resistive track insulated therewithin.

2. A process as set forth in claim 1 including prior to said step (e) the step of laminating said first segment of flexible tape and said second segment of flexible tape to said base plate.

3. A process as set forth in claim 1 wherein said base plate comprises metal.

4. A process as set forth in claim 3 wherein said metal base plate comprises stainless steel.

5. A process as set forth in claim 1 wherein said firing step (e) is conducted at a temperature of from about 800° C. to about 950° C.

6. A process as set forth in claim 1 wherein said first segment of flexible tape and said second segment of flexible tape comprise green low temperature cofired ceramic tape.

7. A process as set forth in claim 1 wherein said resistive track is formed using a thick film resistor paste.

* * * * *